United States Patent [19]

Schwartz

[11] Patent Number: 4,597,194

[45] Date of Patent: Jul. 1, 1986

[54] BIASED-TENSIONED AUXILIARY OUTSOLE MEMBER FOR SHOES

[76] Inventor: Boris Schwartz, 625 Lafayette Ave., Hawthorne, N.J. 07506

[21] Appl. No.: 669,685

[22] Filed: Nov. 9, 1984

[51] Int. Cl.[4] ..... A43B 3/16

[52] U.S. Cl. ..... 36/7.1 R; 36/7.4; 36/32 R

[58] Field of Search ..... 36/30 R, 7.1 R, 7.2 R, 36/32 R, 7.4

[56] References Cited

U.S. PATENT DOCUMENTS 3,757,435 9/1973 Schwartz ..... 36/30 R 4,281,466 8/1981 Malone ..... 36/7.1 R

*Primary Examiner*—Werner H. Schroeder

*Assistant Examiner*—Mary A. Ellis

*Attorney, Agent, or Firm*—Ralph R. Roberts

[57] ABSTRACT

The specification, drawing and claims disclose an auxiliary member that is selectively mountable and removable from a conventional shoe or boot as and when worn by a user. This auxiliary member is adapted to store and release energy as the user makes a striding motion as when walking, jogging, running or combinations thereof. A boat-like upper member has an attached toe and heel sole portion adapted to fit snugly over and on the lower portion of a shoe or boot of a user. A sole portion extends from the toe and heel portions and is unattached to the sides of said upper member. This sole portion is fixedly attached at and to the toe and heel portions to form a substantially continuous sole protective member which provides an outer contact surface during use. A band portion is disposed above the sole portion and extends between the toe and heel sole portions and is securely attached thereto as by molding. This band portion is initially stretched when the auxiliary member is in mounted condition and, with each stride of the user, bending of the sole of the shoe or boot causes a further stretching of the band portion from its initially stretched condition. When the user brings his shoe or boot to a substantially flat "at rest" condition, the energy of bending results in the energy recovery. The auxiliary member is shown with band portions of two lengths and a means of molding in a unitary manner. A separately-attached band portion used with a conventional "rubber" is also shown as providing energy recovery. This band portion is attached at the ends only and is sufficiently thin to not affect the use of the auxiliary outersole member.

9 Claims, 9 Drawing Figures

BIASED-TENSIONED AUXILIARY OUTSOLE MEMBER FOR SHOES

CROSS-REFERENCE TO RELATED U.S. PATENT

This invention pertains to an energy-recovery device for utilizing the striding motion of a wearer to recover a portion of his energy expended in walking. My U.S. Pat. No. 3,757,435, as issued Sept. 11, 1973, provided a means of energy recovery by using tensioned rubber bands between the inner and outer sole of a shoe. This invention pertains to a removable auxiliary device.

BACKGROUND OF THE INVENTION

1. Field of the Invention

With reference to the classification of art as established in and by the U.S. Patent Office, the present invention pertains to the general class entitled "Boots, Shoes and Leggings" (Class 36), and more particularly to resilient additions similar to "rubbers" which may be molded as one piece while providing the resilient stretch members in a protected condition.

2. Description of the Prior Art

The above-identified U.S. Pat. No. 3,757,435 cites six U.S. patents which include U.S. Pat. No. 252,152 to STODDARD; U.S. Pat. No. 2,151,678 to ARMOR; U.S. Pat. No. 2,761,255 to LoPRESTI; U.S. Pat. No. 2,766,503 to MACCARONE; U.S. Pat. No. 2,897,612 to MELTZER and U.S. Pat. No. 2,926,435 to MALING. These as well as the patent above-identified contemplate changes in shoe structure. The present invention provides an auxiliary addition that may be mounted on the shoe of a wearer or removed when desired. This addition is contemplated to be molded as one piece with little weight to each shoe. There is change in the shoe structure and appearance.

In addition to my patent identified above, there have been many attempts to utilize in the shoe or boot of a wearer a portion of the energy developed during and with the gravitational stepping down of the wearer on the shoe and particularly when the shoe is caused to be flexed with the forward stride. Among these attempts is the providing of springs as a member portion of the shank of the shoe whereby as the spring is bowed, energy is stored for release as the wearer completes his or her stride whereat the shoe as urged by the bent spring returns to its initial configuration. These spring attempts have not proved satisfactory in that where the spring in its bending is comfortable enough to walk easily, it does not store sufficient energy to provide any discernible difference and where the spring is stiff enough so that in its bending it provides the desired energy-storing means, the spring exerts uncomfortable pressure upon the instep of the wearer. This area, of course, is one of the more tender areas of the foot. Similarly, many rubber surfaces utilizing the width for energy leverage or to compress air as a spring have not proved satisfactory. "Ripple soles" have provided a springy platform but no stored-energy means.

The present invention provides a recovery wherein a stretched member consisting of a plurality of thin strips of rubber has its outer configuration made to slide along and conform to the outer sole of a shoe or boot. A substantial portion of these rubber bands preferably has through cuts or slits arranged and extending from near the toe portion to the heel portion so that, in essence, a plurality of rubber bands is retained by common means at both ends. In the manner of a rubber exerciser belt or the like, this insert has both its ends secured so that when the shoe is flexed or bent the band portions are more or less equally stretched. Between these attached ends are the bands which are stretched a determined amount.

In the prior art devices known to the applicant, the energy recovery is provided in the shoe or boot. The present invention provides this recovery in an attached member which does not alter the appearance or use of the boot or shoe and, when such an energy device is not required or desired, the member is easily removed and stored for use at a subsequent time.

SUMMARY OF THE INVENTION

This invention may be summarized, at least in part, with reference to its objects.

It is an object of this invention to provide, and it does provide, a boot or shoe in which a stretched rubber-band portion has a tensioned rubber strand portion extending from its toe to its heel portion and with the tensioned rubber-band portions adapted to be further tensioned as the shoe is flexed, said additionally stretched rubber bands storing energy derived from the bending of the shoe during its initial stride and with this initial condition released at the finish of the stride of the wearer.

It is a further object of this invention to provide, and it does provide, an inexpensive method for constructing an auxiliary member mountable on a shoe. This auxiliary member has bands of rubber which are stretched when said auxiliary member is mounted on a shoe or boot so that the bands of rubber provide the desired energy recovery when further stretched. These bands are disposed between and retained by the attached ends at the toe and heel. The additional longitudinal stretching of these strips occurs as the boot or shoe is bent or flexed by a striding procedure of the wearer. This additional stretching of the rubber strips by the bending of the shoe creates and stores energy which is released as the stride or step is completed.

As reduced to practice, energy recovery is easily made by and in the disclosed member which does not alter the appearance or use of a user's shoe or boot. This auxiliary member is easily mounted on and removed from the user's shoe or boot. The member, which is made as are "rubbers" preferably as a unitary molding, has a rubber-tensioned member or bands attached at its fore and rear ends to the toe and heel portions of the auxiliary member. These bands are further stretched during the striding action of the user, with the stored energy recovered at the end of the stride. The nature of the auxiliary member as to the initial tension and the final stretched tension is a matter of design.

In addition to the above summary, the following disclosure is detailed to insure adequacy and aid in understanding of the invention. This disclosure, however, is not intended to prejudice that purpose of a patent which is to cover each new inventive concept therein no matter how it may later be disguised by variations in form or additions of further improvements. For this reason, there has been chosen a specific embodiment of the biased-tensioned outsole member as retained on a shoe or boot. These stretch bands are protected by a bowed sole with said tensioned bands between this bowed sole member and the outer sole of the boot or shoe and showing a preferred means for constructing and retaining the tension-band portions.

Figure 3A:
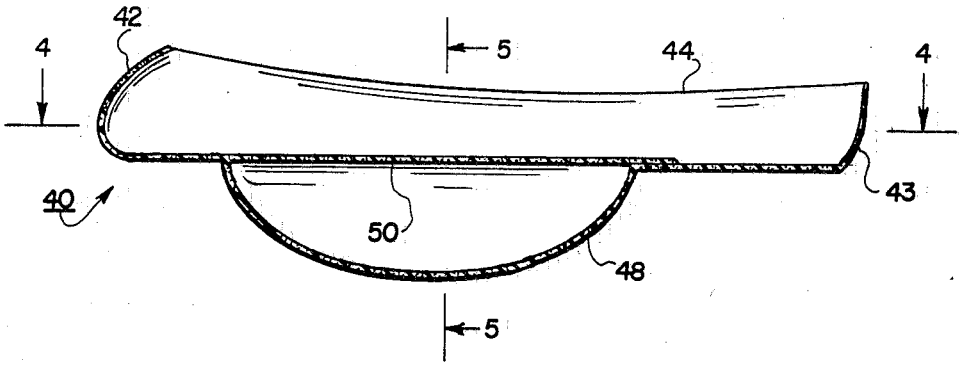
FIGS. 3A and 3B represent side views of the auxiliary added energy-recovery device of this invention, FIG. 3A showing the auxiliary device before placing on a shoe or boot and FIG. 3B showing the auxiliary device is a mounted condition and with the band portion in an initial stretch.

In the following description and in the claims, various details are identified by specific names for convenience. Corresponding reference characters refer to like members throughout the eight figures of the drawings which show a preferred means of recovering energy during walking, jogging or running.

The two sheets of drawings accompanying, and forming part of, this specification disclose structural details which may be modified without departure from the concept and principles of the invention and the invention may be incorporated in other structural forms than shown.

EMBODIMENT OF FIGS. 1A, B, C AND D

Figure 1:
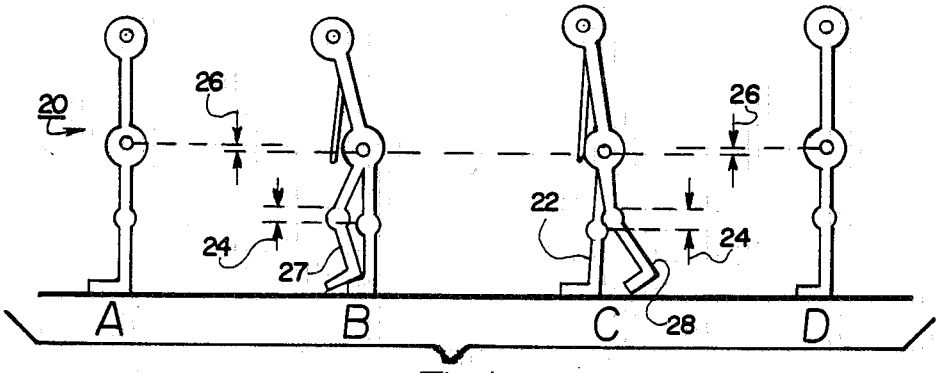
FIGS. 1A, B, C and D represent side views and are quite diagrammatic to illustrate the theory of walking and the recovery of energy provided by this invention.

These views represent a simplified explanation of the theory of walking, although it may also apply to jogging and running, wherein the raising of the leg may be more than in walking. Rather than a detailed drawing of a person, there is shown a stick diagram of a walking person generally identified as 20. In FIG. 1A the body is shown in an upright manner with the feet on the ground and more or less together. In FIG. 1B the initial walking motion is shown wherein a right leg 22 is raised (weighting approximately twenty-five pounds) to a height of about two inches. This distance is a dimension identified as 24. At this stepping motion, the center of gravity of the body will be lowered about one-half the distance of 24 or about one inch, this dimension being identified as 26.

In FIG. 1C the body weight is put on the now straightened-out right leg while the left leg 28 is raised to move said leg forwardly. The left leg is then straightened out and the center of gravity of the body 20 is raised the distance 26. This is shown in FIG. 1D.

Figure 2:
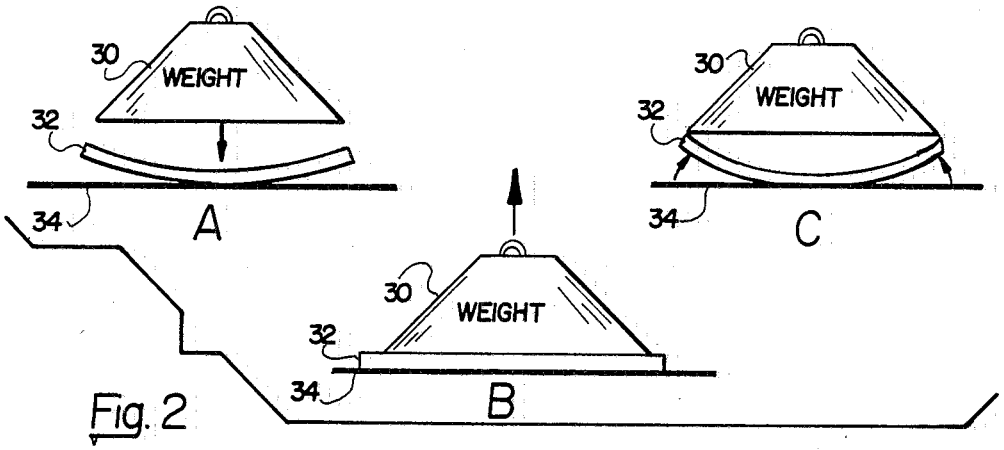
FIGS. 2A, B and C represent diagrammatic steps proving and establishing an equation for energy conversion provided by this invention.

In FIGS. 2A, 2B and 2C, there is diagrammatically shown an energy-recovery theory and proof using a weight 30 of about one hundred fifty pounds, which is the average of a man. The bowed member to be described hereafter is identified as 32 and the ground of flat surface is identified as 36. In FIG. 2A the weight 30 is shown in the lifted condition as in FIG. 1B. In FIG. 2B the weight 30 has caused the bowed member 32 to be flattened to the ground 36. As the foot is lifted, as in FIG. 2C, the force of recovery of member 32 to the bowed condition of FIG. 2A indicates the energy recovery.

A mathematical formula or equation would be:

$$E = \frac{\text{Weight} \times S}{2} \text{ (distance in inches)} = \text{inch-pounds}$$

Assuming the elastic properties of the material used are nearly lineal, the above potential energy-recovery formula or equation may be used. If one lifts the weight of the leg the two inches of dimension 24, the deformation energy is recovered with some negligible loss in function. Assuming the pre-loading provided by the stretched material can be calculated, and assuming that a weight of thirty pounds will flatten the bowed material (which is pre-bent), one inch of the stored energy is when the body weight is lowered, which is:

Energy Stored = thirty pounds × one inch = thirty inch-pounds For each step of the user (in comparison to a regular shoe) and assuming normal parameters, the energy saved or recovered is about twelve percent. This assumes that the weight of leg is about twenty-five pounds and the weight of the human body is about one hundred fifty pounds. The lift of the leg is about two inches. The energy recovered will vary depending upon the body of the person. The above computations are based on the body weight of one hundred fifty pounds and a leg lift of about two inches.

Figure 3B:
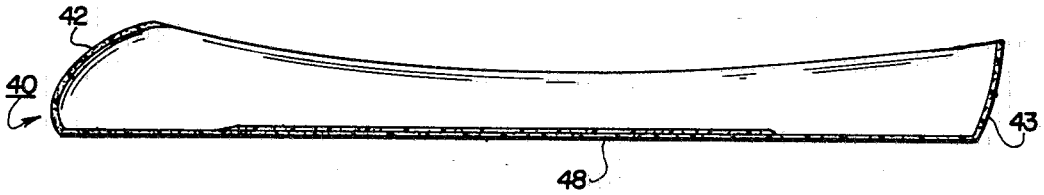

EMBODIMENT OF FIGS. 3A and 3B

It is contemplated that this auxiliary device be of resilient material such as rubber or similar elastic material. This auxiliary device is mounted on and removed from shoes and boots much as are rubbers of conventional construction. Rather than the stretched members interposed between inner and outer soles, as in the patent identified above, the present invention is mounted on existing shoes and/or boots of conventional configuration. As depicted in FIGS. 3A and 3B, this auxiliary device provides a minimum of upper sides or enclosure 40 which is contemplated to be a shallow boat-like configuration with toe and heel portions 42 and 43 of selected configurations. As these views are partly diagrammatic, the inner surface of this auxiliary device is shown in dashed outline. The extent of side portions 44 is determined by the amount of stretch needed to mount and maintain this device in place on the shoe of the user.

In FIGS. 3A and 3B a bowed portion is identified as 48 and is molded as and when the auxiliary unit is molded. This bowed portion provides the exterior sole portion that is disposed to contact the pavement when walking, jogging or running. As molded, there are provided above portion 48 several blends identified as 50 which are better seen and described in later FIGS.

DESCRIPTION OF FIGS. 4, 5 AND 6

Figure 4:
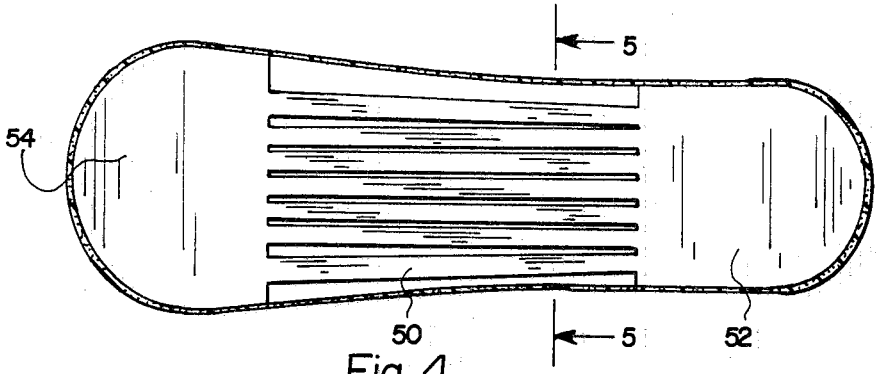
FIG. 4 represents a plan view looking down on the auxiliary devie as molded, this view taken on the line 4—4 of FIG. 3A and looking in the direction of the arrows.
Figure 5:
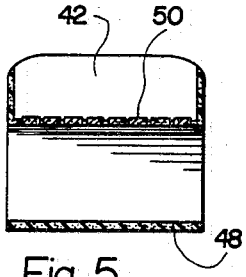
FIG. 5 represents a sectional view of construction of the auxiliary device, this view partly diagrammatic, and taken on the line 5—5 of FIG. 4 and looking in the direction of the arrows.
Figure 6:
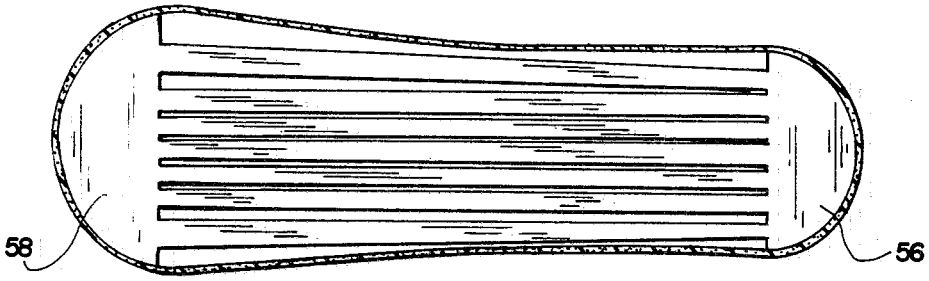
FIG. 6 represents a plan view very similar to FIG. 4, but with the band portion of a greater extent.

In FIGS. 4, 5 and 6 the auxiliary device is shown so as to depict the bands 50 in both the "at rest" condition, as molded, and shown in FIG. 3a, and in the "stretched" condition on the shoe as seen in FIG. 3B. The bands 50 may extend between a heel portion 52 and a toe portion 54 as in FIG. 3A or with a small heel portion 56 and toe portion 58 as seen in FIG. 3B. The extent of bands 50 is merely a matter of selection and molding capability. Whether a heel recess is provided in this auxiliary device or the bottom surface is more or less planar is a matter of selection.

The diagrammatic sectional view of FIG. 5 shows the preferred method of molding the auxiliary device as a unit. The upper portion provides the attachable means to a shoe or a boot of a user. The rubber-band portion, depending on the width of the device, is usually at least five strips, with each end of a strip integrally attached. As in FIG. 3B, the attached and mounted device causes the bands 50 to be stretched a determined extent. The bowed portion 48 provides the sole portion and prevents undue wearing and destruction of the stretched bands 50.

The bowed portion 48 and the extent or length of bands 50 are merely a matter of selection as design, band strength, length, number and cross-section of these bands may be changed to suit particular manufacturing processes and companies. It is to be noted that the tensioned bands 50 are disposed interior of and between the bowed portion 48 and the outer sole of the boot or shoe of the user.

PRODUCTION AS IN FIG. 7

Figure 7:
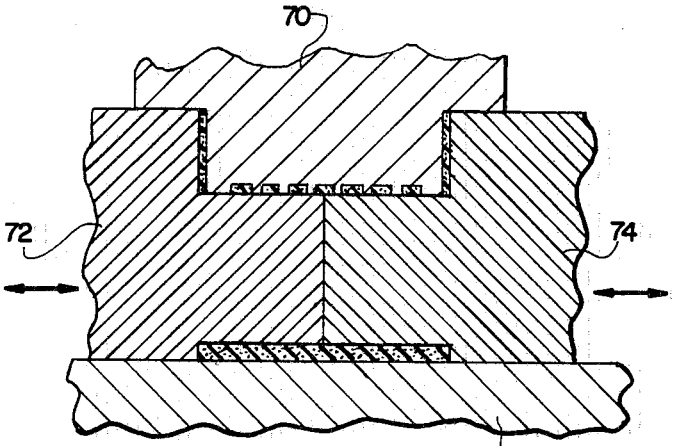
FIG. 7 represents a diagrammatic view taken in section and showing an arrangement of mold construction to form this auxiliary device as a unitarily-molded member.

A method for unitarily molding this auxiliary device is shown in FIG. 7. In this showing, the inner portion of the auxiliary device is formed around and by a contoured mold member 70 which may be carried so as to be removable to the extent that the product after molding can be removed from the member 70. The outer left half of the bottom of the band portions and the upper left half of the surface of the bowed portion are configured by a mold member 72. The right outer side, the right half of the bottom of the band portions and the right half of the upper surface of the bowed portion are formed around the mold member 74. The members 72 and 74 may provide the outer confine of the bowed portion 48, but more likely a separate member 76 may be used to provide an outer confine to a cavity for this auxiliary device.

It is to be noted that this auxiliary device is made in both right- and left-foot members and as pairs are used to recover energy expended by the user of this device. In mounted condition, the auxiliary devices as pairs contemplate that the band portions 50 are stretched to a determined extent. When the shoe or boot is brought to the flat condition of FIG. 1A, the bands are in the condition of initial stretch. When the user bends forward, the auxiliary device is bent to further stretch the bands 50 so that energy is developed in the bands. As and when the user's foot again contacts the ground or support surface to bring the device to the conditions of FIG. 1A, the energy recovery from FIG. 1A to FIG. 1B is the amount of energy recovery developed. Assuming an average weight of a person to be about one hundred fifty pounds and a lift of foot of about two inches, as noted above, the energy recovery is about thirty inch-pounds for every full step.

The conventional shoe or boot when worn by the user is sufficiently stiff to resist easy and unwanted bending. The auxiliary member mounted on the user's shoe or boot has the band members 50 stretched to a given extent and, when the shoe or boot is flexed or bent with a striding action, the bands are further stretched to provide the energy recovery potential. The striding action causes the bands 50 to be stretched further as noted in FIGS. 1A through 1D. The affixed auxiliary member utilizes the bowed portion 48 and the outer sole of the shoe or boot to provide a spaced tunnel in which the stretched bands 50 can and do move in an unattached condition except for their retained ends.

The above-described auxiliary member in FIG. 7 anticipates the molding of the member in a single operation, but this is not to preclude the band portion or portions to be separately made and attached to the toe and heel portions. The band portion 50 in the relaxed condition and with the auxiliary member in unmounted condition necessarily cause the portion 48 to be bowed. This bowed portion is unattached to the sides except at the ends at the toe and heel extents. The auxiliary member is not to be considered a waterproof or exclusion member.

The above disclosed auxiliary member is contemplated to be unitarily molded and the band portions as a plurality of members, but this is not to preclude making the stretched portion providing the energy recovery as a single extent and/or with intermediate holes. It is also contemplated that the outer bowed member, instead of a smooth extent, may be formed with shaped apertures to avoid the showing above. As a practical matter, a simplified molding is contemplated, but improvements in materials and joining means are also practical within the basic concept. An auxiliary outersole member in which an energy-recovery band portion is secured between the toe and heel thereof and protected by a bowed member is considered novel.

In the above description and drawings, the auxiliary member is contemplated to be molded in a single operation and it is contemplated that the mounted auxiliary member would be comfortable to use. The stretched band portion 50 is made to be substantially at the same inner, upper-level surface as the toe and heel portions 52, 54, 56 and 58. The outer bowed portion 48 is also molded so as to present a substantially smooth outer surface to walk on. The showing in FIG. 7 depicts a unitarily molded auxiliary member, but materials and attaching techniques may make the assembly by other means practical and less expensive. The toe and heel portions extending from the ends of the bands may diminish in thickness if desired, and no patentable distinction is ascribed to the thickness of sole but that it be substantial enough to provide a good attaching means.

EMBODIMENT OF FIG. 8

Figure 8:
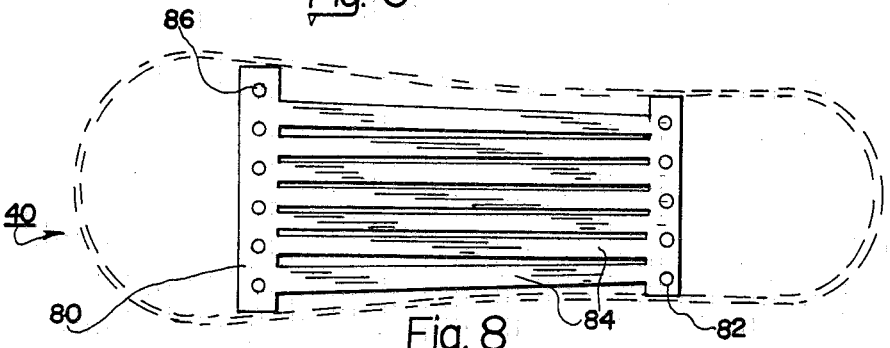
FIG. 8 represents a plan view looking down on the auxiliary device and showing a band portion that is attached to the toe and heel of a "rubber" member without alteration of protection of such a water-resistant member.

Referring next, and finally, to FIG. 8, it is noted and depicted that a molding or a stamping made by a cutting die from a sheet of rubber or rubber-like material provides a band portion for the desired energy recovery. To a "rubbers" member there are contemplated to be attached transverse portions at toe end 80 and heel end 82 and therebetween a band portion 84. Sonic welding, heat spot welding or a rapid adhesive securing are contemplated to provide a commercial means for attaching this energy-recovery member to the inner sole portions of the enclosing member 40. The extent of the attaching toe and heel end portions 80 and 82 is merely a matter of selection. When attached, the band portion 84 will cause the midportion of the enclosure member to bow or buckle much like that shown in FIG. 3A. In a mounted condition, the band portions 84 are stretched to bring the mounted member 40 to the condition of FIG. 3B. This concept enables conventional wet or damp-weather "rubber" to perform its anticipated use while also providing energy recovery. It is also contemplated and desirable that these added end portions 80 and 82 and the band portion 84 therebetween are relatively thin so as to avoid undue thickness in the sole of the auxiliary member as and when mounted on the shoe or boot of a user. Band portions are shown as the flex or bending of the shoe or boot often is slightly uneven and a plurality of strands allows stretch without undue twisting. A single cut or trimmed sheet is also contemplated, but for the above reasons is not preferred. The material from which the energy-recovery insert is made, although resilient, usually has a small portion of release material in the mixture or compound so as to minimize friction of one to another.

The showing in FIG. 8 contemplates that the band portions 84 are integrally attached to toe and heel portions 80 and 82, but this is not to preclude forming and furnishing individual strips and attaching these strips at their ends. The strips and ends are contemplated to be of a thickness such as one-eighth to three-sixteenths of an inch in thickness to insure this added thickness does not affect the comfort of the user. So that the added band portio does not have excess friction with the auxiliary member, the band portion may have additives such as polymerized tetrafluoroethylene material added to the mixture.

The cross-section of the bands 50 is shown as substantially rectangular, but other shapes may be used and are contemplated. It is only required that the bands be substantial enough to withstand stretching. The bands are usually from one-eighth to three-sixteenths of an inch in thickness but may be more or less. It is only required that the auxiliary member when mounted be comfortable as to walking, jogging and/or running. The band 50 must be slideable on the inner surface of sole member 48. This may require that a small portion of Teflon (TM DuPont), chemically identified as polymerized tetrafluoroethylene, be added to the resilient material to assist in sliding one on another. It is noted that in the molding of the member as in FIG. 7, there is shown a separation means between bands. This is beneficial in that the use of several bands allows the stretching of these bands to be made as to the extent required and this stretching to accommodate the foot actuation without locally affecting the bending of the shoe.

The above disclosure is believed to provide a basis for method steps for unitarily molding an outersole member. These steps include:

(a) providing and shaping a male die portion to form the inner surface of a boat-like upper member including an attached toe and heel sole portion, this upper member sized to fit snugly over and on the shoe or boot of a user;

(b) providing and shaping mating side die portions to form the outer side extents of the boat-like upper member and also inwardly-extending portions which mate and form mold surfaces for the inner extent of a sole portion extending from the toe and heel portions and providing a shut-off to an attachment to the sides of said upper member, said mold in an assembled condition providing a cavity in which this sole portion is fixed attached at and to the toe and heel portions to form a substantially continuous sole protective member which provides an outer contact surface, and (c) forming in the male die portion shaping the inner surface of the auxiliary member a band portion whose lower surface is formed by the inwardly-extending portions of the side die portions, said band portion extending between the toe and heel sole portions and securely attached thereto, this band portion initially stretched when the auxiliary member is in mounted condition and, with each stride of the user, bending of the sole of the shoe or boot causing a further stretching of the band portion from its initially stretched condition.

Terms such as "up," "down," "in," "out" and the like are applicable to the embodiments shown and described in conjunction with the drawings. These terms are merely for the purposes of description and do not necessarily apply to the position in which the biased-tensioned auxiliary outsole member may be constructed or used.

While particular embodiments of the biased-tensioned auxiliary outsole member have been shown and described, it is to be understood that the invention is not limited thereto and protection is sought to the broadest extent the prior art allows.

What is claimed is:

1. An auxiliary outersole member that is selectively mountable and removable from a conventional foot covering as and when worn by a user, this auxiliary member adapted to store and release energy as the user makes a striding motion when walking, jogging, running and combinations thereof, this auxiliary member including:

(a) a boat-like upper member including an attached toe and heel sole portion, this upper member adapted to fit snugly over and on the lower portion of a foot covering of a user;

(b) a resilient sole portion sufficiently flexible to be bent to the configuration of the sole of the foot covering, with this sole portion extending from the toe and heel portions and unattached to the sides of said upper member, said sole portion being fixedly attached at and to the toe and heel portions to form a substantially continuous sole protective member which provides an outer contact surface, and (c) a band portion which includes a plurality of substantially like strips and disposed above said sole portion and extending between the toe and heel sole portions and securely attached thereto, this band portion initially stretched when the auxiliary member is in mounted condition and, with each stride of the user, bending of the sole of the foot covering causing a further stretching of the band portion from its initially stretched condition, and when the user brings his foot covering to a substantially flat "at rest" condition the energy of bending resulting in the further stretching of band portion is recovered.

2. An auxiliary outersole member, as in claim 1, in which the band portion is made as a plurality of bands with the ends thereof attached at the sole portions of the toe and heel.

3. An auxiliary outersole member, as in claim 1, in which the energy recovery provided by the additional stretch is about ten percent of the weight of the user of this outsole member.

4. An auxiliary outersole member, as in claim 2, in which the band portions are at least five in number and are generally rectangular in cross-section.

5. An auxiliary outersole member, as in claim 4, in which the thickness of the bands is between one-eighth and three-sixteenths of an inch.

6. An auxiliary outersole member, as in claim 1, in which the composition of resilient material includes a small percentage of polymerized tetrafluoroethylene.

7. An auxiliary outersole member that is selectively mountable and removable from a conventional foot covering as and when worn by a user, this auxiliary member adapted to store and release energy as the user makes a striding motion when walking, jogging, running and combinations thereof, this auxiliary member including:

(a) a boat-like upper member including an attached toe and heel sole portion, this upper member adapted to fit snugly over and on the lower portion of a foot covering of a user, this member having an outersole portion extending from the toe to the heel portions and providing therewith a continuous sole protective member as an outer contact surface, this sole portion and the sides of this upper member joined to provide a moisture- and particle-excluding means, and (b) a separate band portion which includes a plurality of substantially like strips having toe and heel attached portions and a band portion extending between the toe and heel portions, these band portions and the attached end portions in an attached condition disposed to lie above said sole portion and securely attached to the inner surface of the auxiliary member at the toe and heel portions thereof, this band portion initially stretched when the auxiliary member is in mounted condition and, with each stride of the user, bending of the sole of the foot covering causing a further stretching of the band portion from its initially stretched condition, and when the user brings his foot covering to a substantially flat "at rest" condition the energy of bending resulting in the further stretching of band portion is recovered.

8. An auxiliary outersole member, as in claim 7, in which the band portions are plural and generally rectangular and have a thickness of between one-eighth and three-sixteenths of an inch.

9. An auxiliary outersole member, as in claim 7, in which the mixture from which the band portion is made has a small percentage of polymerized tetrafluoroethylene added to the product to make the finished band portion.

* * * * *